US008651479B2

(12) United States Patent
Onishi

(10) Patent No.: US 8,651,479 B2
(45) Date of Patent: Feb. 18, 2014

(54) RECORDING MEDIUM DELIVERY DEVICE AND IMAGE FORMING APPARATUS INCLUDING THE SAME

(75) Inventor: Yuzo Onishi, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 0 days.

(21) Appl. No.: 13/269,702

(22) Filed: Oct. 10, 2011

(65) Prior Publication Data

US 2012/0112402 A1 May 10, 2012

(30) Foreign Application Priority Data

Nov. 4, 2010 (JP) ..... 2010-246985
Sep. 1, 2011 (JP) ..... 2011-190261

(51) Int. Cl.
*B65H 31/00* (2006.01)
*B65H 31/26* (2006.01)

(52) U.S. Cl.
USPC ..... 271/220; 271/209; 271/207

(58) Field of Classification Search
USPC ..... 271/220, 207–209; 399/406, 405
See application file for complete search history.

(56) References Cited

U.S. PATENT DOCUMENTS

| | | | | |
|---|---|---|---|---|
| 4,951,935 | A * | 8/1990 | Oikawa | 271/208 |
| 5,033,731 | A * | 7/1991 | Looney | 271/176 |
| 7,865,127 | B2 * | 1/2011 | Nakajima | 399/406 |
| 2012/0038101 | A1 * | 2/2012 | Osaki | 271/209 |

FOREIGN PATENT DOCUMENTS

| | | |
|---|---|---|
| JP | 2004-123395 | 4/2004 |
| JP | 2005-96964 | 4/2005 |

* cited by examiner

*Primary Examiner* — Luis A Gonzalez
(74) *Attorney, Agent, or Firm* — Smith, Gambrell & Russell, LLP

(57) ABSTRACT

A sheet delivery device (80) includes a sheet presser member (61), which is positioned in the vicinity of a sheet delivery port (53) on a downstream side in a sheet delivery direction, for pressing a trailing end of a sheet to be delivered from the sheet delivery port (53). The sheet presser member (61) includes a side surface portion (61*a*), which is positioned to face a leading end of the sheet to be delivered from the sheet delivery port (53) and a bottom surface portion (61*b*) which is projected from a lower end of the side surface portion (61*a*) toward the downstream side in the sheet delivery direction.

20 Claims, 9 Drawing Sheets

RECORDING MEDIUM DELIVERY DEVICE AND IMAGE FORMING APPARATUS INCLUDING THE SAME

This application is based upon and claims the benefit of priority from the corresponding Japanese Patent Application No. 2010-246985 filed on Nov. 4, 2010, and Japanese Patent Application No. 2011-190261 filed on Sep. 1, 2011, the entire contents of which are incorporated herein by reference.

BACKGROUND OF THE INVENTION

1. Field of the Invention

The present invention relates to a recording medium delivery device for delivering a recording medium in a sheet form, which is to be mounted on an image forming apparatus such as a copying machine, a printer, and a facsimile machine, and relates to an image forming apparatus including the recording medium delivery device. In particular, the present invention relates to an improvement in stacking property of a recording medium onto a recording medium delivery tray for holding the delivered recording medium and improvement in detecting property of a fully-loaded state of the stacked recording media.

2. Description of Related Art

In the conventional image forming apparatuses, in order to ensure a stacking amount of delivered sheets and a good stacking property, a sheet delivery tray has a tray surface with its length and gradient set to a predetermined dimension and a predetermined angle, respectively, in conformity to a sheet size, a sheet delivery speed, and the like. Further, in order to prevent the stacked sheets from blocking a sheet delivery port, there is provided a full-load detecting mechanism for detecting whether or not sheets delivered to the sheet delivery tray are equal to or larger than a predetermined amount.

By the way, in some cases, the sheet having received heat and pressure by a fixing portion of the image forming apparatus may suffer from large curls (curling tendency) depending on conditions such as a paper thickness and a moisture amount of the sheet, and a roller pressure of a pressure roller of the fixing portion. When the sheet locally curls as described above, an alignment property and the stacking property of the sheets delivered onto the sheet delivery tray are remarkably degraded. Further, when a trailing end of the sheet delivered onto the sheet delivery tray is upwardly curled, the trailing end of the sheet adversely blocks the sheet delivery port before the stacking amount of the sheets reaches the predetermined amount.

In this context, conventionally, there is provided a sheet presser member, which is extended substantially perpendicularly and downwardly with respect to a sheet delivery direction from an upper portion of the sheet delivery port, to thereby improve the alignment property and the stacking property of the sheet by pressing the curled sheets. For example, there is known a configuration in which a mounting position of a Mylar (polyethylene terephthalate film) as presser means is adjusted to be in a suitable range, to thereby effectively press both right and left end portions of the sheet, which tend to easily curl in particular.

Further, there is known a configuration in which the sheet presser member is provided concentrically with the full-load detecting member, and the sheet having a small width is pressed only by the full-load detecting member while the sheet having a large width is pressed by both of the sheet presser member and the full-load detecting member, to thereby press the sheet at an appropriate pressing force in accordance with the sheet width.

However, the presser means (Mylar) and the sheet presser member described above are sheet-form or plate-form members for pressing the curls at both end portions in the width direction of the sheet, and hence it has been impossible to effectively press a curl portion in a case where the trailing end of the sheet is upwardly curled.

SUMMARY OF THE INVENTION

The present invention has been made in view of the above-mentioned problems, and has an object to provide a recording medium delivery device capable of suppressing both curls at a trailing end and at both end portions in a width direction of a recording medium, and to provide an image forming apparatus including the recording medium delivery device.

In order to achieve the above-mentioned object, according to one aspect of the present invention, there is provided a recording medium delivery device, including: a delivery port through which a recording medium is delivered; a delivery tray onto which the recording medium delivered from the delivery port is to be stacked; and a presser member, which is supported in a vicinity of the delivery port on a downstream side in a delivery direction of the recording medium so as to be swingable in parallel to the delivery direction, the presser member including a side surface portion, which is positioned to face the delivery port, and a bottom surface portion, which is projected from a lower end of the side surface portion toward the downstream side in the delivery direction of the recording medium and is capable of pressing, from above, a trailing end of the recording medium delivered from the delivery port.

Further features and advantages of the present invention will become apparent from the description of embodiments given below.

DETAILED DESCRIPTION OF PREFERRED EMBODIMENTS

Figure 1:
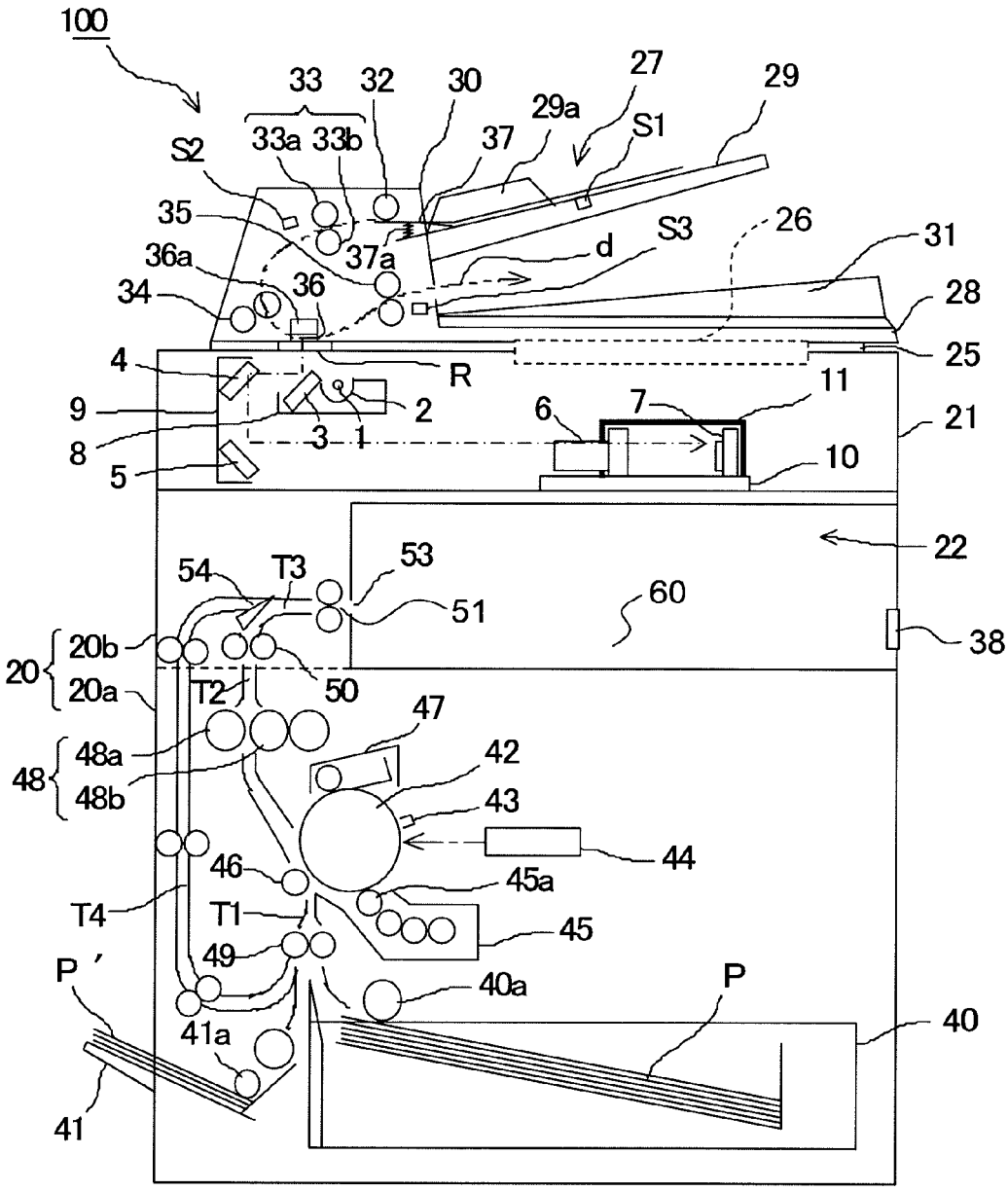
FIG. 1 is a cross-sectional front view illustrating an inner configuration of an image forming apparatus 100 to which a sheet delivery device 80 according to the present invention is mounted.

Hereinafter, embodiments of the present invention are described with reference to the drawings. FIG. 1 is a cross-sectional front view illustrating an inner configuration of an image forming apparatus to which a sheet delivery device according to the present invention is mounted. An image forming apparatus 100 according to the present invention is what is known as an internal-delivery type digital copying machine, and basically includes an apparatus main body 20 and an image reading portion 21 provided on the apparatus main body 20. The image reading portion 21 includes various mechanisms described later, for reading an image on a document as an electric signal. Meanwhile, the apparatus main body 20 includes various mechanisms described later, for transferring an image onto a sheet based on the electric signal of the read document image.

In FIG. 1, the apparatus main body 20 includes a lower housing 20*a* and a connection housing 20*b*, which is positioned on the lower housing 20*a* along the left side portion and is connected to the image reading portion 21. The lower housing 20*a* includes a sheet feeding portion for feeding the sheet, an image forming portion for forming a toner image onto the sheet, and a fixing portion for fixing the toner image onto the sheet. Meanwhile, the connection housing 20*b* includes a sheet delivery device for conveying and delivering the sheet which has been subjected to fixing.

An internal sheet-delivery space 22 which opens widely toward the right lateral side and the front side is formed on the right lateral side of the connection housing 20*b*, which is provided immediately below the image reading portion 21. On the lower side of the internal sheet-delivery space 22, there is provided a sheet delivery tray 60 for receiving and stacking the sheets which are horizontally delivered from the right side surface of the connection housing 20*b*. In the side surface of the connection housing 20*b*, a sheet delivery port 53 is provided so as to communicate with the internal sheet-delivery space 22, and the sheet is delivered onto the sheet delivery tray 60 therethrough. A leading end regulating member 38 is provided on an end portion of the sheet delivery tray 60 on a downstream side in a delivery direction, which prevents the delivered sheet from slipping out from a tray surface.

On an upper surface of the image reading portion 21, there are provided a document placing plate 25 made of a transparent glass plate and an operation panel 26 exposed on the front side. Further, above the image reading portion 21, a document holding member 28, onto which a document conveyance device 27 for conveying a document to an image reading position of the document placing plate is mounted, is openably and closably supported by a hinge portion provided on a back side of the image reading portion 21.

Next, a configuration of the document conveyance device 27 is described. Inside a document cover 30, there is provided document conveyance means including, sequentially from an upstream side along a document conveyance path d, a pickup roller 32, a document conveyance roller pair 33, a registration roller pair 34, and a document delivery roller pair 35. Among those members, the document conveyance roller pair 33 includes a drive roller 33*a* and a separation roller 33*b*. A torque limiter is built in the separation roller 33*b*, and the separation roller 33*b* is rotated in accordance with the rotation of the drive roller 33*a* only in a case where the rotation load exceeds predetermined torque.

Between the registration roller pair 34 and the document delivery roller pair 35, there are provided a white reference plate 36 for shading correction, which is exposed so as to face an image reading position R in the document placing plate 25, and a document pressing portion 36*a*, which is provided on the back side of the white reference plate 36, for pressing the white reference plate 36 toward the image reading position R. Note that, the document conveyance path d is curved in a U-shape so as to be reversed from the document conveyance roller pair 33 to reach the image reading position R.

Further, in the document conveyance path d, a plurality of sensors for detecting presence and absence of the document are provided at appropriate places. For example, a document detecting sensor S1 is provided at a center portion of a document feeding tray 29, a sheet feeding sensor S2 is provided on the downstream side of the document conveyance roller pair 33, and a delivery sensor S3 is provided on the downstream side of the document delivery roller pair 35.

The image reading portion 21 is capable of performing two types of reading methods, that is, a sheet-through method in which the document is automatically conveyed by the document conveyance device 27 to be read while the document holding member 28 is closed, and a document stationary method in which the document on the document placing plate 25 is replaced one by one by opening and closing the document holding member 28 each time the reading operation is performed. Note that, in the former sheet-through method, the reading operation of the document is performed while retaining an optical system provided in the image reading portion 21 at a predetermined position without moving the optical system for scanning. Meanwhile, in the latter document stationary method, the reading operation is performed while moving the optical system for scanning.

Next, referring to FIG. 1, a document conveyance operation in the sheet-through method performed by the document conveyance device 27 is described. In the document conveyance operation in the sheet-through method, first, a plurality of documents set on the document feeding tray 29 so that the image surfaces thereof face upward are pressed against the pickup roller 32 at a predetermined pressure by a set document presser member 37 biased upwardly by a spring member 37*a*. Here, when a copying start button of the operation panel 26 is turned ON, the pickup roller 32 and the document conveyance roller pair 33 are rotated and driven by primary sheet feeding drive means (not shown).

Several documents on the upper side of the documents set on the document feeding tray 29 are generally conveyed to the document conveyance roller pair 33 by the pickup roller 32. The separation roller 33*b* separates only the uppermost document of the several documents conveyed to the document conveyance roller pair 33, and then the separated document is conveyed toward the registration roller pair 34. At this time, the document is conveyed by a predetermined distance after the leading end of the document is detected by the sheet feeding sensor S2, and then, with the operation stop of the primary sheet feeding drive means, the rotating and the driving of the drive roller 33*a* of the document conveyance roller pair 33 and the pickup roller 32 are stopped, to thereby finish the primary sheet feeding. The document which has been primarily fed has its leading end pressed at a nip portion between the registration roller pair 34, and is stopped under a state in which the leading end portion thereof is bent.

After a predetermined time period has elapsed after the primary sheet feeding is finished, a secondary sheet feeding is started. In other words, with the operation of secondary sheet feeding drive means (not shown), the registration roller pair 34 is rotated and driven. The document is conveyed toward the document delivery roller pair 35 via the image reading position R by the registration roller pair 34, and after that, is finally delivered on a document delivery tray 31 by the document delivery roller pair 35. At this time, when the delivery sensor S3 detects that the trailing end of the document has passed, it is detected that the image reading of one document is finished.

Here, the delivery sensor S3 has a count function of counting the number of documents every time the feeding and conveying of the document is finished. When the document detecting sensor S1 detects the subsequent document, the document conveyance of a second document and subsequent documents is continued in the same way as above. Note that, when the document passes the image reading position R, the document is conveyed while being lightly pressed toward the document placing plate 25 by the white reference plate 36 and the document pressing portion 36*a*, and an image on the document is read through the image reading position R.

Subsequently, a configuration inside the image reading portion 21 is described below with reference to FIG. 1. In the image reading portion 21, there are provided a lamp 1 as a light source for emitting light toward the image surface of the document, a reflection plate 2 for efficiently reflecting the light from the lamp 1 to the image surface of the document, a first mirror 3 which directly receives and reflects the light reflected from the document, a second mirror 4 which receives and reflects the light reflected from the first mirror 3, and a third mirror 5 which receives and reflects the light reflected from the second mirror 4. Further, on a base plate 10, there are provided a lens barrel 6 holding a lens group (not shown) which introduces and condenses the light reflected from the third mirror 5, and a photoelectric conversion module (for example, a line-type CCD) 7 which receives the light reflected from the document, which has been condensed by the lens group in the lens barrel 6, and converts the light into an electric signal. Note that, an optical path of the light reflected from the document is indicated by the long and short dash line.

Here, the lamp 1, the reflection plate 2, and the first mirror 3 are integrally fixed onto a first carriage 8, and the second mirror 4 and the third mirror 5 are integrally fixed onto a second carriage 9. The first carriage 8 and the second carriage 9 are independent of each other, but are capable of reciprocating in association with each other. That is, when the reading operation of the document image is performed using the above-mentioned sheet-through method, the first carriage 8 moves to and is held at a position immediately below the image reading position R, and the second carriage 9 is held at a predetermined position. On the other hand, when the reading operation of the document image is performed using the document stationary method, the first carriage 8 and the second carriage 9 mutually reciprocate (move for scanning) while maintaining a constant optical path length of the light reflected from the document.

With this configuration, the light reflected from the document, which is first emitted from the lamp 1 and then reflected off the image surface of the document, is then reflected by the first to third mirrors 3 to 5, to thereby be introduced into the lens group in the lens barrel 6 to be condensed by the lens group. Then, the condensed light forms an image on a photoelectric conversion element of the photoelectric conversion module 7. The photoelectric conversion module 7 performs photoelectric conversion processing, and the document image is read as an electric signal.

Subsequently, referring to FIG. 1, configurations of various mechanisms, which are provided in the apparatus main body 20, for forming a toner image based on the electric signal of the read document image and transferring the formed toner image onto a sheet are described. First, a sheet feeding portion is described. At a lower portion of the lower housing 20*a*, there is provided a sheet feeding cassette 40 which stores sheets of various sizes (such as paper sheet and OHP sheet) and can be inserted into or removed from the front side of the lower housing 20*a*. Large-size sheets P stored in the sheet feeding cassette 40 are fed one by one by a feeding roller 40*a*. Further, in the left side surface at the lower portion of the lower housing 20*a*, an openable and closable manual feed tray 41, which can be pulled down when needed, is provided. Small-size sheets P' set on the manual feed tray 41 are fed one by one by a feeding roller 41*a*.

Next, the image forming portion for forming the toner image on the sheet and the fixing portion for fixing the toner image on the sheet are described. A photosensitive drum 42, which principally constitutes the image forming portion, is positioned above the sheet feeding cassette 40 in the lower housing 20*a*. A charging device 43, a laser exposure unit 44, a development device 45, a transfer roller 46, and a cleaning device 47 are provided around the photosensitive drum 42. Further, in the lower housing 20*a*, a fixing device (fixing portion) 48 is provided above the transfer roller 46 and immediately below the connection housing 20*b*.

The photosensitive drum 42 is made of, for example, positively charged amorphous silicon and rotates in a clockwise direction in FIG. 1 at a predetermined peripheral velocity when being driven. The surface of the photosensitive drum 42 is uniformly charged by a corona discharge generated by the charging device 43 to which a high voltage is applied, and is then irradiated with a light beam emitted from the laser exposure unit 44 based on the electric signal of the document image from the above-mentioned photoelectric conversion module 7. In this manner, an electrostatic latent image including predetermined light potential portions and dark potential portions is formed.

Further, by the rotation of the photosensitive drum 42, the electrostatic latent image is rotated and moved to a development position. A development roller 45*a*, which is a component of the development device 45, is made of stainless steel and has a stationary magnet therein. The development roller 45*a* is rotatably supported with a predetermined distance from the photosensitive drum 42 and, when being driven, is rotated in the same direction as the photosensitive drum 42 at a predetermined peripheral velocity. The development device 45 is loaded with positively charged magnetic toner having, for example, a volume average particle size of 9 μm (median size measured by a Coulter counter). A magnetic blade (not shown) forms a thin toner layer on the surface of the development roller 45*a*. Further, a predetermined development bias is applied to the development roller 45*a*. The development bias causes the thin toner layer that has reached the development position by the rotation of the development roller 45*a* to transport from the surface of the development roller 45*a* to be adsorbed to the electrostatic latent image formed on the surface of the photosensitive drum 42, to thereby form (develop) a toner image.

Here, the sheets P (or P') stacked on the sheet feeding cassette 40 (or the manual feed tray 41) are fed upwardly one by one so as to reach a sheet feeding registration roller pair 49. The sheet P (or P'), which has reached the sheet feeding registration roller pair 49, is conveyed from the sheet feeding registration roller pair 49 to between the photosensitive drum 42 and the transfer roller 46 through a conveyance path T1 while a conveyance timing thereof being adjusted so as to be synchronized with the timing at which the toner image on the photosensitive drum 42 approaches the transfer roller 46. Then, the sheet P passes through the transfer roller 46 in a manner that the leading end of the sheet P and the leading end of the toner image match with each other, and thus most of the toner of the toner image is transferred onto the sheet P.

The toner that is not transferred onto the sheet P and remains on the surface of the photosensitive drum 42 is removed from the photosensitive drum 42 by the cleaning device 47. Meanwhile, the sheet P onto which the toner image has been transferred is conveyed to the fixing device 48. The fixing device 48 includes a fixing roller pair including a heating roller 48*b* and a pressure roller 48*a*. The fixing roller pair heats, pressurizes, and fixes the transferred image onto the sheet P which passes through a nip portion of the fixing roller pair, to thereby fix the transferred image onto the sheet P.

The sheet P having passed through the fixing device 48 is directly conveyed into the connection housing 20*b* along a vertical conveyance path T2 extending vertically and upwardly. In the connection housing 20*b*, there are provided a sheet conveyance roller pair 50 connected to the vertical conveyance path T2 and a sheet delivery roller pair 51 for delivering the sheet P onto the sheet delivery tray 60. The sheet P sent out from the sheet conveyance roller pair 50 passes through a conveyance path T3 to reach the sheet delivery roller pair 51, and then is delivered from the sheet delivery roller pair 51 through the sheet delivery port 53 to the sheet delivery tray 60.

Meanwhile, in a case of duplex printing in which images are formed on both surfaces of the sheet P, the sheet P having passed through the fixing device 48 is once conveyed in the sheet delivery roller pair 51 direction, and then a part of the sheet P is delivered onto the sheet delivery tray 60 from the sheet delivery port 53. Then, after the trailing end of the sheet P has passed through a branch portion 54, the sheet delivery roller pair 51 is rotated reversely and a conveyance direction of the branch portion 54 is switched. In this manner, the sheet P is sorted (switched back) to an inverting conveyance path T4 from the trailing end thereof, and is conveyed again to the sheet feeding registration roller pair 49 under a state in which an image surface is inverted. Then, a subsequent image formed on the photosensitive drum 42 is transferred onto a surface of the sheet P, on which an image is not formed, by the transfer roller 46, and after the sheet P is conveyed to the fixing device 48 to fix the toner image, the sheet P is delivered from the sheet delivery roller pair 51 through the sheet delivery port 53 to the sheet delivery tray 60.

Figure 2:
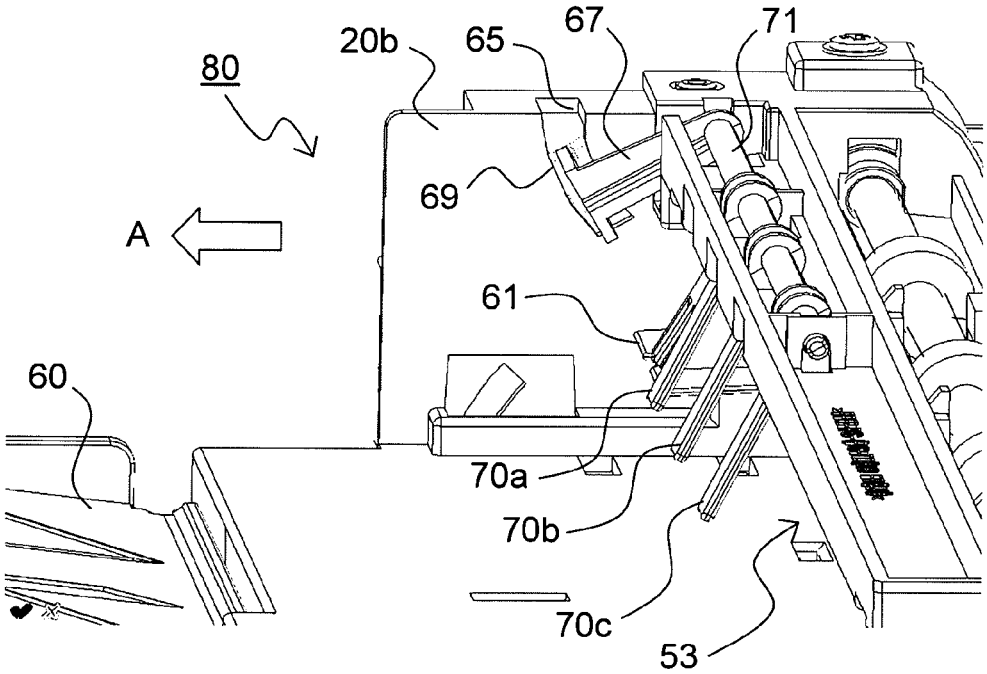
FIG. 2 is a partial perspective view of the sheet delivery device 80 according to a first embodiment of the present invention.
Figure 3:
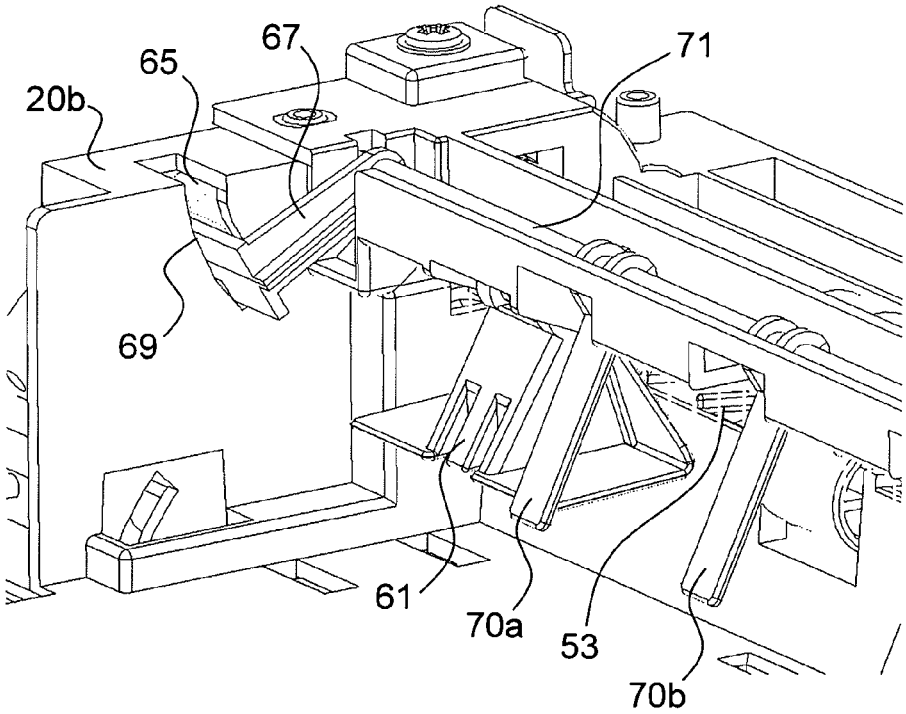
FIG. 3 is an enlarged view around a sheet presser member 61 in the case of FIG. 2.

FIG. 2 is a partial perspective view of a sheet delivery device 80 according to a first embodiment of the present invention, when viewed from the back side of FIG. 1, and FIG. 3 is an enlarged view around a sheet presser member 61 in the case of FIG. 2. Note that, FIG. 2 illustrates a periphery of the left end portion of the sheet delivery port 53, and FIGS. 2 and 3 illustrate a state in which the image reading portion 21 is removed for simplicity of description. The sheet delivery device 80 includes at least the sheet delivery port 53, the sheet delivery tray 60, and the sheet presser member 61.

Above and apart from sheet delivery tray 60 and in the vicinity of the sheet delivery port 53 on the downstream side in a sheet delivery direction (direction indicated by the arrow A of FIG. 2), the sheet presser member 61 for pressing the trailing end of the sheet to be delivered from the sheet delivery port 53 is provided. The sheet presser member 61 is provided at each of both right and left end portions of the sheet delivery port 53 and is supported so as to be swingable in the sheet delivery direction with a first swing shaft 63 (see FIG. 6) as a spindle. Further, the sheet presser member 61 is arranged so as to overlap with a full-load detecting member 70*a* (described later) when viewed from the sheet delivery direction.

Figure 4:
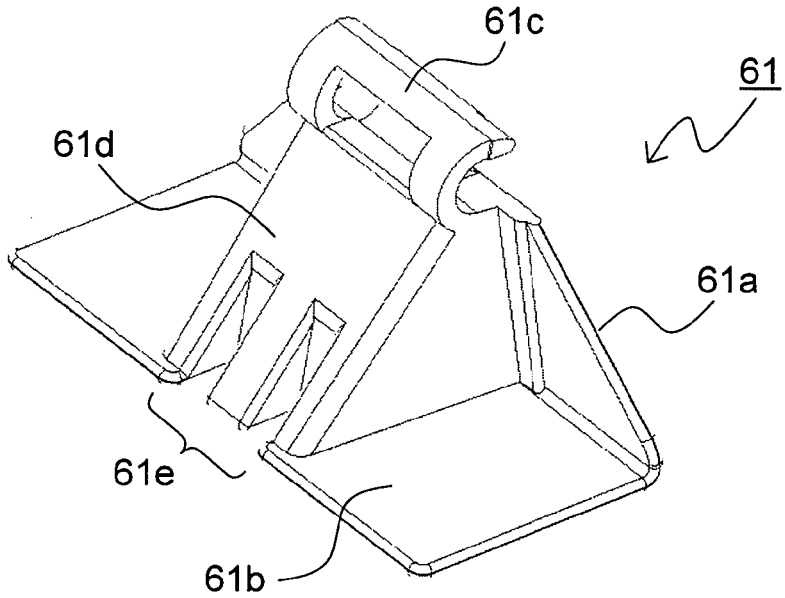
FIG. 4 is a perspective view of an example of an external appearance of the sheet presser member 61 used in the sheet delivery device 80 of the first embodiment, when viewed from a front side.
Figure 5:
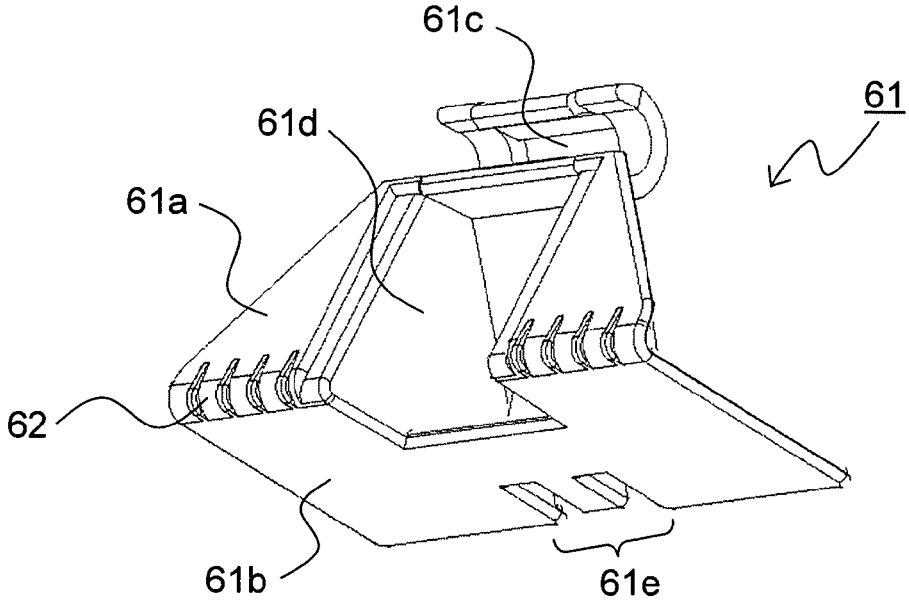
FIG. 5 is a perspective view of the external appearance of the sheet presser member 61 of FIG. 4, when viewed from a back side.

FIGS. 4 and 5 are perspective views of the external appearance of the sheet presser member 61 used in the sheet delivery device 80 of the first embodiment, when viewed from the front side and the back side, respectively. The sheet presser member 61 is a member integrally formed by a synthetic resin, and includes a side surface portion 61*a* facing the sheet delivery port 53 (see FIG. 2) and a bottom surface portion 61*b* projected from a lower end of the side surface portion 61*a* toward the downstream side in the sheet delivery direction. On an upper end of the side surface portion 61*a*, a bearing portion 61*c*, which is swingably fitted to the first swing shaft 63, is formed.

Further, a brace portion 61*d* is formed so as to connect the center portion of the side surface portion 61*a* and the bottom surface portion 61*b*. The brace portion 61*d* has a cavity shape opened on the side surface portion 61*a* side thereof, and has an unevenness 61*e* like hairpin curves formed in the end portion on the downstream side in the sheet delivery direction of the brace portion 61*d*. The brace portion 61*d* plays a role of enhancing the rigidity of the sheet presser member 61 and decentering the center of gravity of the sheet presser member 61 toward the downstream side in the sheet delivery direction. Further, a corner portion 62 is formed at a portion at which the side surface portion 61*a* and the bottom surface portion 61*b* intersect each other.

Note that, the sheet presser members 61 are arranged at both the end portions of the sheet delivery port 53, and hence the small-size sheet is delivered onto the sheet delivery tray 60 without being brought into contact with the sheet presser members 61. However, there are no problems because curls are less likely to occur in the small-size sheet at both end portions in a width direction and a trailing end thereof, and the small-size sheets are stably stacked onto the sheet delivery tray 60 even without the sheet presser members 61, without a fear that the small-size sheets block the sheet delivery port 53.

Referring back to FIGS. 2 and 3, right near and on the downstream side of the sheet presser member 61, there are provided a plurality of (three in this case) full-load detecting members 70*a*, 70*b*, and 70*c*, which swing in parallel to the sheet delivery direction in accordance with the stacking amount of the sheets stacked on the sheet delivery tray 60. The full-load detecting members 70*a* to 70*c* are fixed to a second swing shaft 71, which is swingably supported by the connection housing 20*b*. Among the three full-load detecting members 70*a* to 70*c*, the full-load detecting member 70*a* which is positioned on the outermost side of the sheet width direction is arranged at a position capable of being brought into contact with a large-size (for example, A3-size) sheet. Similarly, the center full-load detecting member 70*b* is arranged at a position capable of being brought into contact with a middle-size (for example, A4-size) sheet, and the full-load detecting member 70*c* which is positioned on the innermost side is arranged at a position capable of being brought into contact with a small-size (for example, B5-size) sheet.

Onto one end of the second swing shaft 71, a light blocking plate 67 for switching ON and OFF of an upper surface detecting sensor 65 is fixed. The light blocking plate 67 reciprocates, along a guide groove 69 formed in the inner wall surface of the connection housing 20*b*, from the lowermost position to the uppermost position of the guide groove 69 in accordance with the swinging of the full-load detecting members 70*a* to 70*c*.

The upper surface detecting sensor 65 is a photo-interrupter (PI) sensor provided with a detecting portion including a light emitting portion and a light receiving portion provided at opposing inner surfaces of a U-shape in plan view. When the light blocking plate 67 moves to the uppermost position of the guide groove 69 to block the optical path of the detecting portion, the level of a signal of the light received at the detecting portion is switched from HIGH to LOW. With this, it is possible to detect the upper surface position of the sheets stacked on the sheet delivery tray 60, that is, the stacking amount of the sheets. When it is detected that the sheets on the sheet delivery tray 60 are fully loaded, for example, a liquid crystal display portion of the operation panel 26 (see FIG. 1) displays a message to notify the user.

Next, a sheet delivery operation of the sheet delivery device 80 of this embodiment is described. FIGS. 2 and 3 illustrate a state (default state) before delivering the sheet, and the sheet presser member 61 has its center of gravity decentered on the downstream side in the sheet delivery direction. Therefore, under a state in which the sheet presser member 61 is remaining still by its own weight, the bottom surface portion 61*b* is inclined downwardly toward the downstream side in the sheet delivery direction, and the side surface portion 61*a* is inclined in a direction approaching delivery tray 60 from the downstream side to the upstream side in the sheet delivery direction. Further, the full-load detecting members 70*a* to 70*c* are arranged at such positions (reference positions) that the full-load detecting members 70*a* to 70*c* make a closest approach to the sheet delivery tray 60 by their own weights, and the light blocking plate 67 is positioned at the lowermost position of the guide groove 69.

Figure 6:
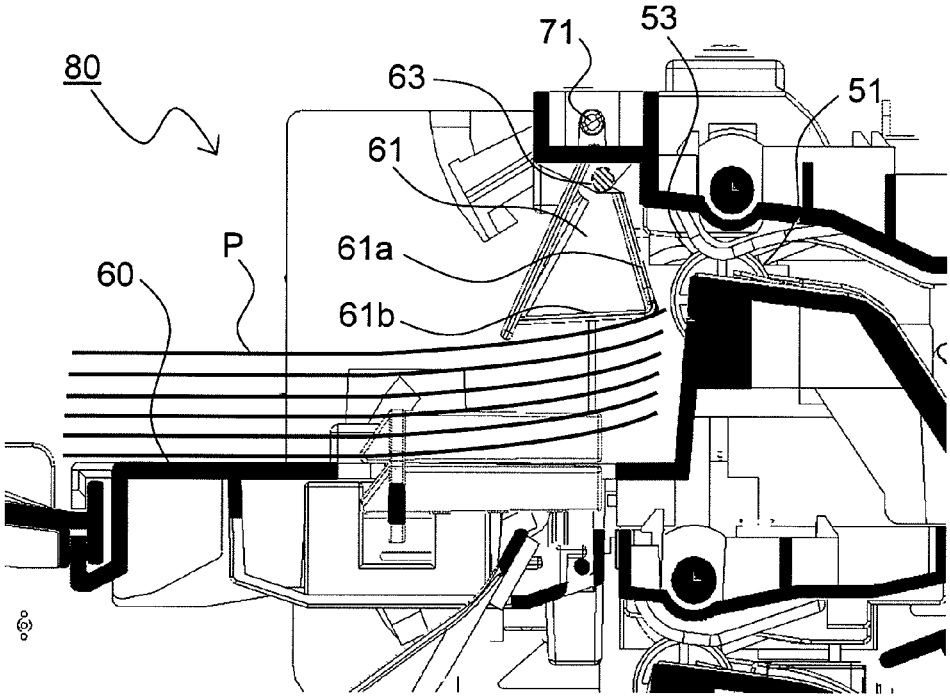
FIG. 6 is a cross-sectional side view of the sheet delivery device of the first embodiment, illustrating a state in which large-size sheets are stacked on a sheet delivery tray 60.

FIG. 6 is a cross-sectional side view illustrating a state in which, in the sheet delivery device 80 of the first embodiment, large-size sheets are stacked on the sheet delivery tray 60. The leading end of the large-size (for example, A3-size) sheet P delivered from the sheet delivery roller pair 51 through the sheet delivery port 53 is brought into contact with the side surface portion 61*a* of the sheet presser member 61. Then, while causing the sheet presser member 61 to swing toward the downstream side in the sheet delivery direction, the large-size sheets P are sequentially stacked onto the sheet delivery tray 60 along the bottom surface portion 61*b*, which is inclined downwardly toward the downstream side in the sheet delivery direction.

The sheets P are stacked under a state in which the trailing ends thereof are slid under the bottom surface portion 61*b* of the sheet presser member 61. Therefore, the trailing end of the sheet P delivered from the sheet delivery port 53 is pressed by the bottom surface portion 61*b* from above. Here, as illustrated in FIGS. 4 and 5, the bottom surface portion 61*b* of the sheet presser member 61 has a rectangular shape which widens in the sheet delivery direction and the sheet width direction. Therefore, the curls of the sheet P at both the end portions in the width direction can be pressed, and also the curl of the sheet P at the trailing end can be pressed.

Further, under a state in which the sheet presser member 61 is remaining still by its own weight, the bottom surface portion 61*b* is inclined downwardly toward the downstream side in the sheet delivery direction, and the corner portion 62 (see FIGS. 4 and 5) at which the side surface portion 61*a* and the bottom surface portion 61*b* intersect each other is positioned on the upstream side of the first swing shaft 63 in the sheet delivery direction. Therefore, when the curl of the sheet P at the trailing end pushes up a portion on the upstream side in the delivery direction of the bottom surface portion 61*b*, a force acts so as to swing the sheet presser member 61 toward the upstream side in the delivery direction. With this, the sheet presser member 61 does not swing toward the downstream side in the sheet delivery direction, and the bottom surface portion 61*b* becomes less likely to be apart from the upper surface of the stacked sheets P.

As the stacking amount of the sheets P on the sheet delivery tray 60 becomes larger, the sheet presser member 61 is pushed by the upper surface of the sheet P so as to gradually pivot toward the downstream side in the sheet delivery direction, and hence the position of the bottom surface portion 61*b* also moves toward the downstream side in the sheet delivery direction. As a result, it becomes difficult to sufficiently press the trailing end of the sheet P, and particularly in a case where the curl of the sheet P at the trailing end is large, there is a fear that the sheets P on the sheet delivery tray 60 block the sheet delivery port 53 before being fully loaded.

Figure 7:
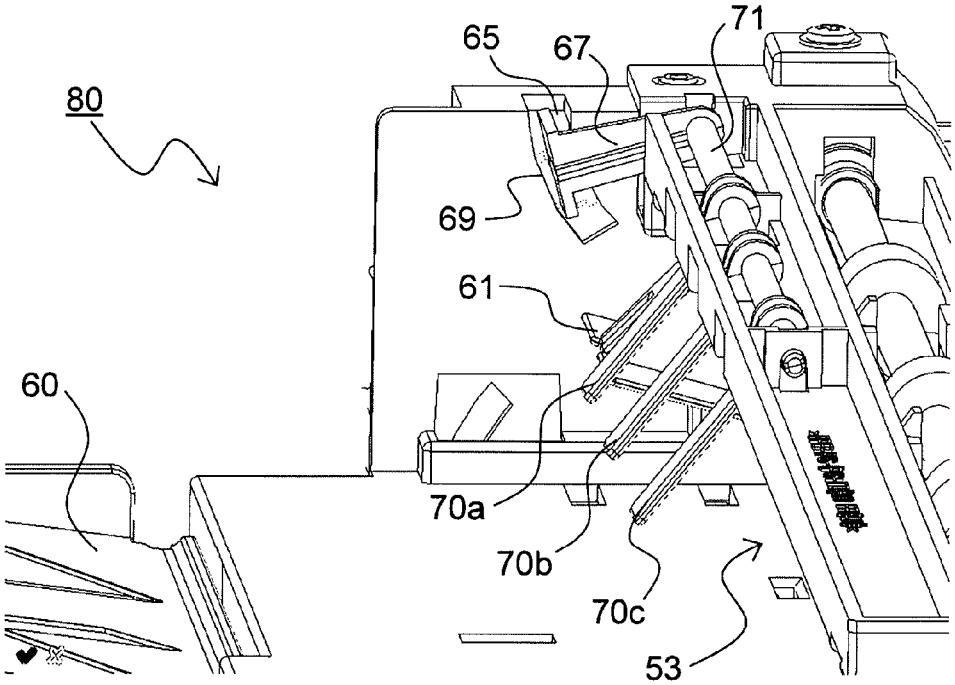
FIG. 7 is a partial perspective view of the sheet delivery device of the first embodiment, when a stacking amount of the large-size sheets on the sheet delivery tray 60 becomes large.
Figure 8:
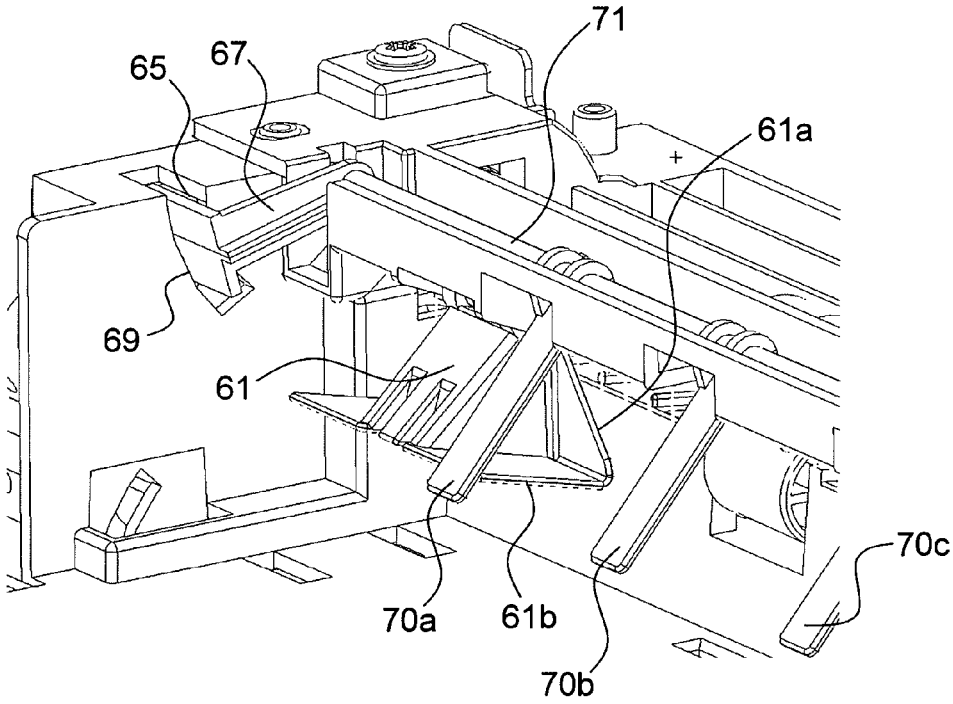
FIG. 8 is an enlarged view around the sheet presser member 61 in the case of FIG. 7.

FIG. 7 is a partial perspective view of the sheet delivery device 80 of the first embodiment (periphery of the left end portion of the sheet delivery port 53) viewed from the back side of FIG. 1, when the stacking amount of the large-size sheets on the sheet delivery tray 60 becomes large in the sheet delivery device 80, and FIG. 8 is an enlarged view around the sheet presser member 61 in the case of FIG. 7. Note that, for simplicity of description, illustration of the sheet is omitted in FIGS. 7 and 8. In this embodiment, as described above, the sheet presser member 61 is arranged so as to overlap with the full-load detecting member 70*a* when viewed from the sheet delivery direction, and hence the swing trace of the sheet presser member 61 and the swing trace of the full-load detecting member 70*a* also overlap with each other.

With this configuration, the sheet presser member 61 pushed by the delivered sheet abuts against the full-load detecting member 70*a* from the upstream side in the sheet delivery direction, and the full-load detecting member 70*a* upwardly swings together with the sheet presser member 61. Further, along with the swinging of the full-load detecting member 70*a*, the second swing shaft 71 is also rotated, and the light blocking plate 67 also upwardly moves along the guide groove 69. Then, when the full-load detecting member 70*a* swings up to a predetermined position (detecting position), the light blocking plate 67 reaches the uppermost position of the guide groove 69 so as to block the light in the detecting portion of the upper surface detecting sensor 65. As a result, it is determined that the sheet delivery tray 60 is in a full-load state, and the operation panel 26 displays an alert message.

Therefore, even when the upper surface of the sheets P stacked on the sheet delivery tray 60 is not directly brought into contact with the full-load detecting member 70*a*, as the sheet presser member 61, which is held in contact with the upper surface of the sheets P, pivots toward the downstream side in the sheet delivery direction, the full-load detecting member 70*a* is pushed upwardly, which makes it possible to detect the stacking amount by the full-load detecting member 70*a* and the upper surface detecting sensor 65. Therefore, it is possible to notify the user in advance that there is a fear that the sheet delivery port 53 may be blocked by the curl of the sheet P at the trailing end before the sheets P on the sheet delivery tray 60 are in a fully-loaded state.

Further, the sheet presser member 61 is arranged so as to be held in contact with only the full-load detecting member 70*a* positioned on the outermost side in the sheet width direction, and is not held in contact with the full-load detecting members 70*b* and 70*c*. Therefore, when the middle-size or small-size sheets, which have small curl at the sheet trailing end and are not required to be pressed by the sheet presser member 61, are stacked on the sheet delivery tray 60, only the full-load detecting member 70*b* or 70*c* pivots so as to move the light blocking plate 67 from the reference position to the detecting position. In this manner, the full-load state is detected with high accuracy.

Here, the full-load detecting members 70*a* to 70*c* swing about the second swing shaft 71, which is different from the first swing shaft 63 of the sheet presser member 61. Therefore, there is no fear that the sheet presser member 61 rotates together in association with the full-load detecting members 70*b* and 70*c*. Therefore, when the small-size sheet, which has a lower stiffness compared to that of the large-size sheet, is delivered, swing load of the sheet presser member 61 is not applied, and it is possible to smoothly stack the sheets on the sheet delivery tray 60. Further, the fully-loaded state of the sheets can be detected with high accuracy.

Note that, in the default state illustrated in FIGS. 2 and 3, the sheet presser member 61 may abut against the full-load detecting member 70*a*, or may be arranged with a predetermined distance from the full-load detecting member 70*a* instead. In a case where there is a distance between the sheet presser member 61 and the full-load detecting member 70*a*, the sheet presser member 61 abuts against the full-load detecting member 70*a* when the sheet presser member 61 swings by a predetermined angle, and then, the full-load detecting member 70*a* upwardly swings together with the sheet presser member 61.

As described above, in the sheet delivery device 80 of the first embodiment, regardless of the size of the sheet to be delivered, it is possible to accurately detect the full-load state of the sheet delivery tray 60, and further, in a case where the large-size sheet, which is likely to curl at both the end portions in the sheet width direction and the trailing end thereof, is delivered, it is possible to detect the full-load state before the curl at the trailing end blocks the sheet delivery port 53 to notify the user. As a result, a user-friendly sheet delivery device is obtained.

Figure 9:
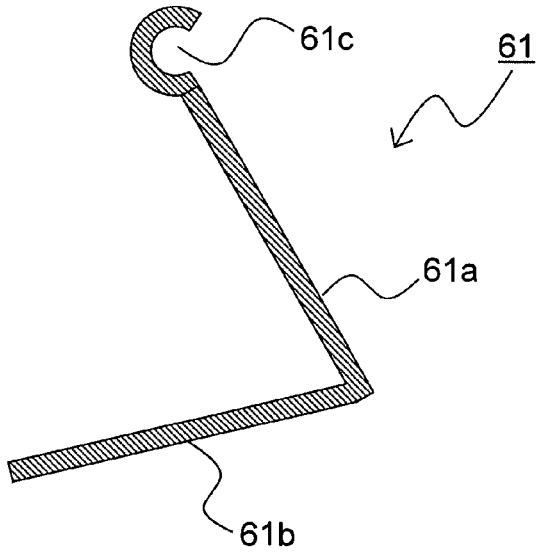
FIG. 9 is a side view illustrating another configuration example of the sheet presser member 61 used in the sheet delivery device 80 of the first embodiment.

Further, the shape of the sheet presser member 61 is not limited to the shape illustrated in FIGS. 4 and 5. As long as the configuration includes the side surface portion 61*a* facing the leading end of the sheet to be delivered from the sheet delivery port 53 and the bottom surface portion 61*b* projected from the lower end of the side surface portion 61*a* toward the downstream side in the sheet delivery direction, a sheet presser member 61 having an L-shape in side view as illustrated in FIG. 9 may be used.

Figure 10:
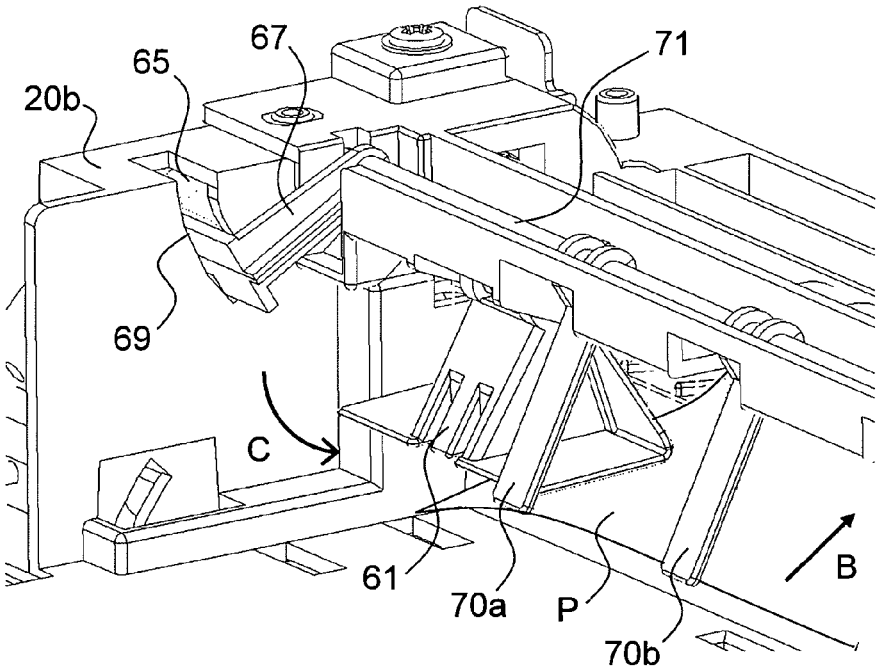
FIG. 10 is a partial perspective view illustrating a state in which a sheet P is switched back by the sheet delivery device 80 of the first embodiment.

By the way, in the above-mentioned sheet delivery device 80 of the first embodiment, in order to perform duplex printing, when the sheet P once delivered from the sheet delivery port 53 is switched back by the reverse rotation of the sheet delivery roller pair 51 to sort the sheet P to the inverting conveyance path T4 (see FIG. 1), as illustrated in FIG. 10, in some cases, the sheet presser member 61 pivots in a direction indicated by the arrow C by friction between the bottom surface portion 61*b* and the upper surface of the sheet P, which is drawn in the sheet delivery port 53 direction (direction indicated by the arrow B), and thus the sheet presser member 61 is pulled to be in the default state (see FIGS. 2 and 3).

Figure 11:
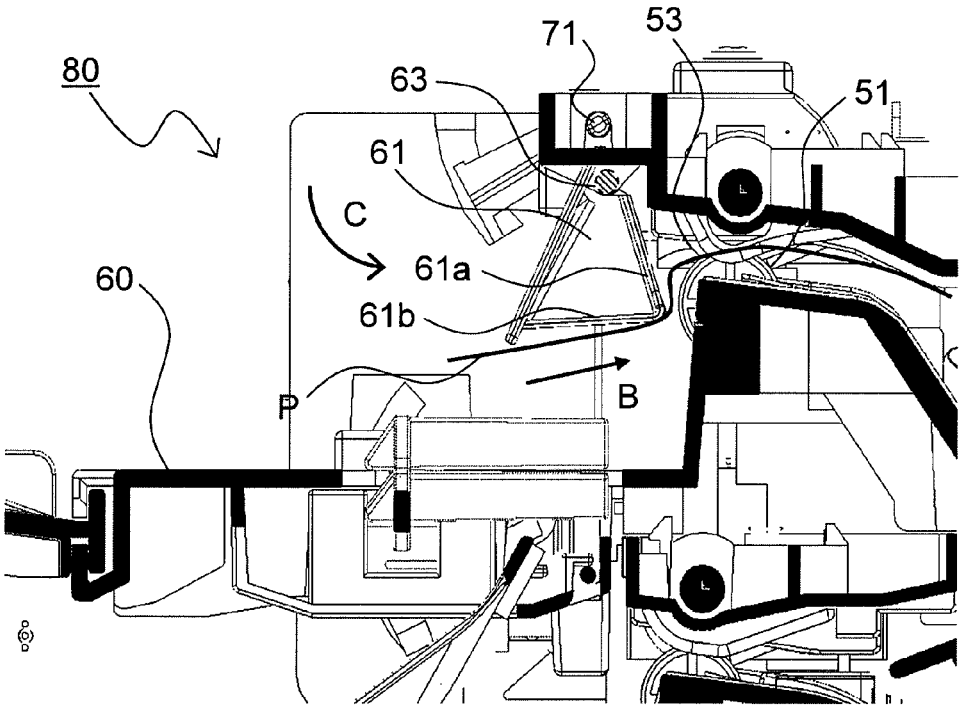
FIG. 11 is a cross-sectional side view illustrating the state in which the sheet P is switched back by the sheet delivery device 80 of the first embodiment.

As a result, as illustrated in FIG. 11, the end portion in the width direction of the sheet P is greatly bent between an end portion (corner portion 62) on the upstream side in the delivery direction of the sheet presser member 61 and the nip portion of the sheet delivery roller pair 51, which causes large torsion to be applied to the sheet P. By the torsion applied to the sheet P, the conveyance load on the end portion in the width direction of the sheet P drastically increases, and skew feed of the sheet P occurs. The skew feed of the sheet P causes paper jam in the inverting conveyance path T4. The above-mentioned problem is particularly conspicuous when only the end portion in the width direction of the sheet P is brought into contact with the sheet presser member 61, and when a sheet P having low stiffness is to be conveyed.

Figure 12:
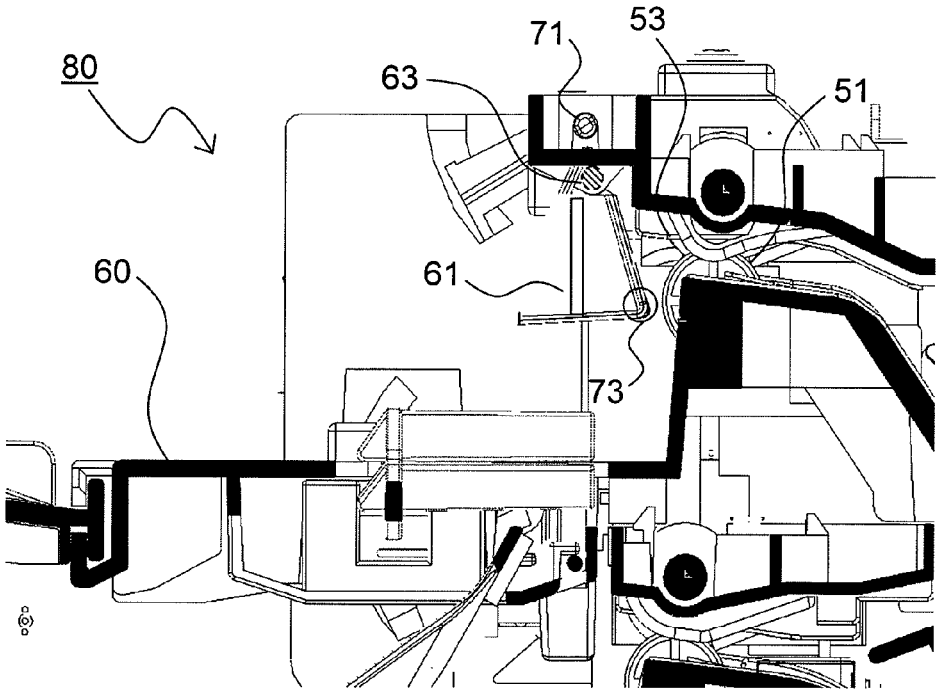
FIG. 12 is an enlarged view around a sheet presser member 61 in a sheet delivery device 80 according to a second embodiment of the present invention.
Figure 13:
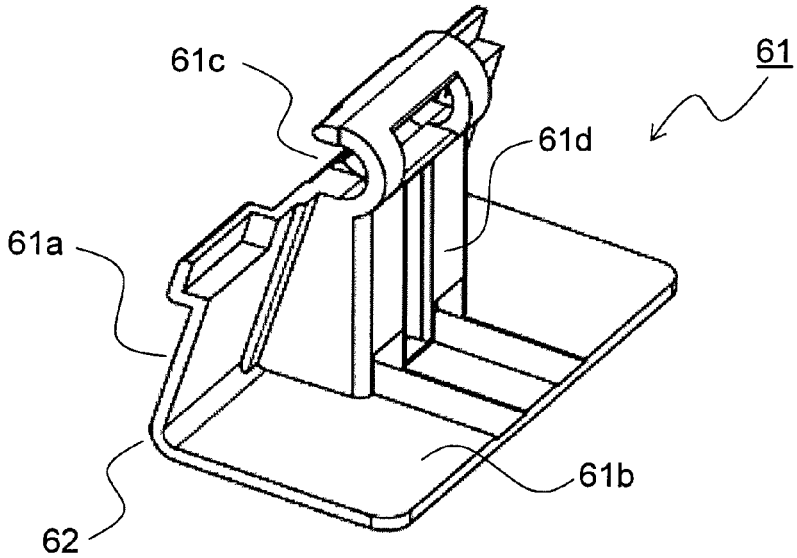
FIG. 13 is a perspective view of an external appearance of the sheet presser member 61 used in the sheet delivery device 80 of the second embodiment, when viewed from a front side.
Figure 14:
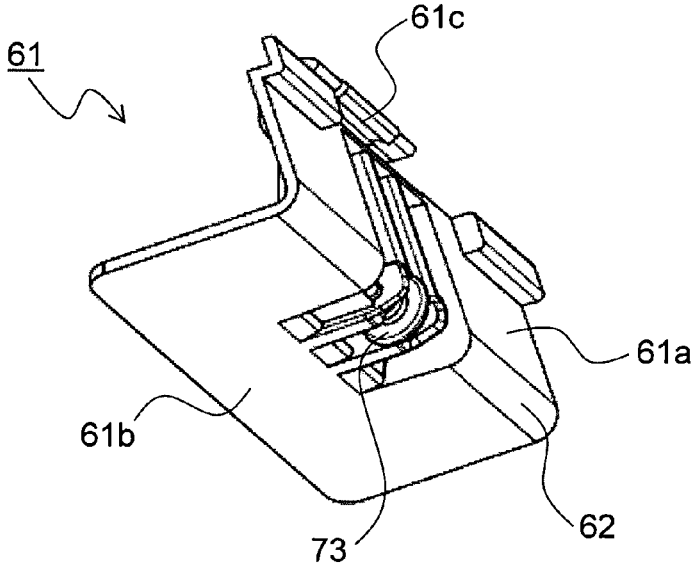
FIG. 14 is a perspective view of the external appearance of the sheet presser member 61 used in the sheet delivery device 80 of the second embodiment, when viewed from a back side.

FIG. 12 is a cross-sectional side view around a sheet presser member 61 of a sheet delivery device 80 according to a second embodiment of the present invention, and FIGS. 13 and 14 are perspective views of an external appearance of the sheet presser member 61 used in the sheet delivery device 80 of the second embodiment, when viewed from a front side and a back side, respectively. The sheet presser member 61 to be used in this embodiment includes a roller 73 rotatably provided at the corner portion 62 at which the side surface portion 61*a* and the bottom surface portion 61*b* intersect each other. Structures of other parts of the sheet presser member 61 and other parts of the sheet delivery device 80 including the full-load detecting members 70*a* to 70*c* are similar to those of the first embodiment.

Figure 15:
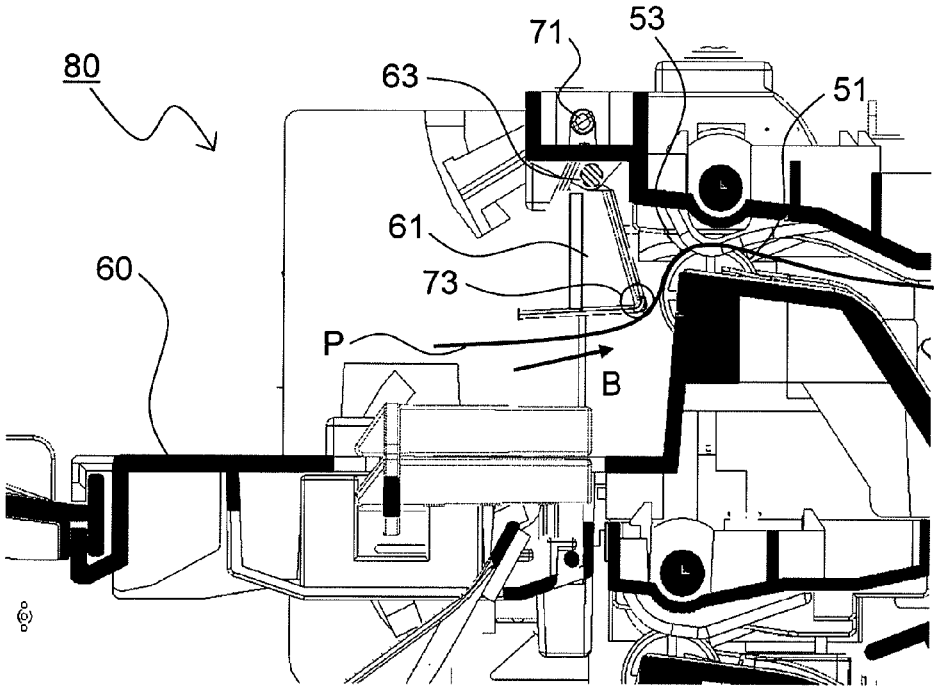
FIG. 15 is a cross-sectional side view illustrating a state in which a sheet P is switched back by the sheet delivery device 80 of the second embodiment.

FIG. 15 is a cross-sectional side view illustrating a state in which a sheet P is drawn with the use of the sheet delivery device 80 of the second embodiment. As illustrated in FIG. 15, the end portion in the width direction of the sheet P is drawn inside the image forming apparatus 100 while being brought into contact with the corner portion 62 of the sheet presser member 61. Here, the corner portion 62 is provided with the roller 73, and hence the friction between the sheet P and the corner portion 62 is reduced.

Therefore, it is possible to suppress a phenomenon that the sheet presser member 61 is pulled to be in the default state by the friction with the sheet P, and thus torsion is not applied to the end portion in the width direction of the sheet P between the end portion (corner portion 62) on the upstream side in the delivery direction of the sheet presser member 61 and the nip portion of the sheet delivery roller pair 51. As a result, also increase in conveyance load on the end portion in the width direction of the sheet P does not occur, and hence it is possible to effectively suppress the skew feed at the time of switch back of the sheet P and occurrence of paper jam in the inverting conveyance path T4.

Figure 16A:
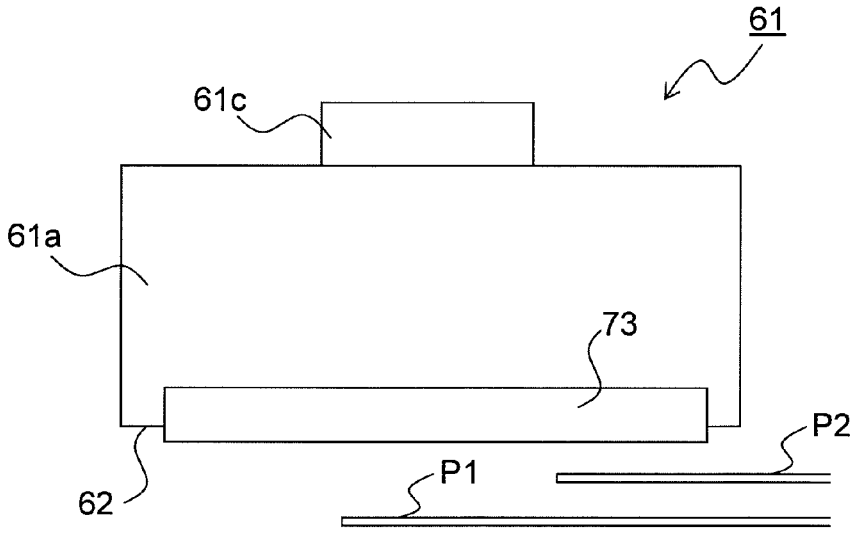
FIG. 16A is a back view illustrating another configuration example of the sheet presser member 61 used in the sheet delivery device 80 of the second embodiment.

Note that, in the sheet delivery device 80 of this embodiment, the roller 73 is provided at a substantially center portion in the width direction of the corner portion 62, but as illustrated in FIG. 16A, the roller 73 having a slender cylinder shape may be provided across substantially the entire region in the width direction of the corner portion 62. With this, the friction between the corner portion 62 of the sheet presser member 61 and sheets of a plurality of sizes can be effectively reduced regardless of the sheet width, the sheets of a plurality of sizes including, for example, a sheet P1 having a sheet width (for example, A3-size) substantially equal to the width of the sheet delivery port 53, a sheet P2 having a sheet width (for example, B4-size) slightly smaller than the width of the sheet delivery port 53, or a sheet having a width intermediate therebetween. Further, the sheet presser member 61 can be used in common even in the sheet delivery device 80 used for sheets having different widths.

Figure 16B:
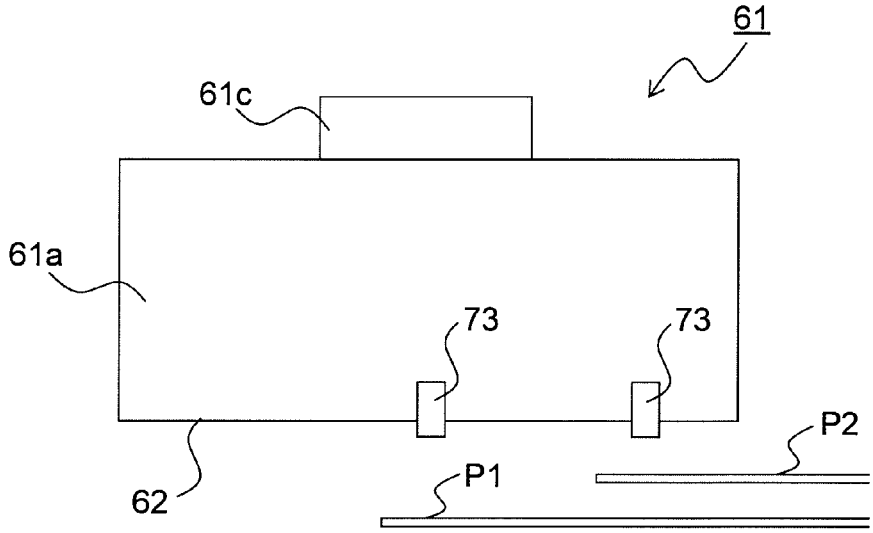
FIG. 16B is a back view illustrating still another configuration example of the sheet presser member 61 used in the sheet delivery device 80 of the second embodiment.

Further, in a case where the sizes of the sheets P to be delivered from the sheet delivery device 80 are fixed, the rollers 73 may be provided at positions corresponding to the sheet widths of the sheets to be used. For example, in a case where the A3-sized sheet P1 and the B4-sized sheet P2 are delivered, as illustrated in FIG. 16B, the rollers 73 may be provided at two positions of the corner portion 62 of the sheet presser member 61, which are contactable to the sheets P1 and P2, respectively.

Besides, the present invention is not limited to the above-mentioned embodiments, and various modifications may be made thereto without departing from the gist of the present invention. For example, the above-mentioned embodiments describe the sheet delivery device used in the internal-delivery type image forming apparatus, but the present invention is similarly applicable to a sheet delivery device used in a case where the sheet is delivered on the upper side or the lateral side of the image forming apparatus, or in a case where the document is conveyed by the document conveyance device to the document reading portion, and after the document image is read, the document is delivered.

The present invention can be used in a recording medium delivery device for delivering a recording medium in a sheet form on a delivery tray, and the recording medium delivery device includes a presser member, which is supported in a vicinity of a delivery port on a downstream side in a delivery direction of the recording medium so as to be swingable in parallel to the delivery direction, the presser member including a side surface portion, which is positioned to face a leading end of the recording medium to be delivered from the delivery port, and a bottom surface portion, which is projected from a lower end of the side surface portion toward the downstream side in the delivery direction of the recording medium and is capable of pressing, from above, a trailing end of the recording medium delivered from the delivery port.

With this, it is possible to provide a sheet delivery device capable of effectively suppressing occurrence of curls at both end portions in a width direction of a recording medium and a curl at a trailing end thereof with a simple configuration.

What is claimed is:

1. A recording medium delivery device, comprising:

a delivery port through which a recording medium is delivered;

a delivery tray onto which the recording medium delivered from the delivery port is to be stacked; and a presser member which is supported above and apart from the delivery tray and in a vicinity of the delivery port on a downstream side in a delivery direction of the recording medium so as to be swingable in parallel to the delivery direction, the presser member having a side surface portion, which is positioned to face the delivery port, and a bottom surface portion, which is projected from a lower end of the side surface portion toward the downstream side in the delivery direction of the recording medium and is capable of pressing, from above, a trailing end of the recording medium delivered from the delivery port, wherein, under a state in which the presser member is remaining still by its own weight, the side surface portion is inclined in a direction approaching the delivery tray from the downstream side to an upstream side in the delivery direction, and the side surface portion contacts a leading end of the recording medium delivered through the delivery port.

2. A recording medium delivery device according to claim 1, wherein the presser member comprises a corner portion at which the side surface portion and the bottom surface portion intersect each other, the corner portion being positioned on an upstream side of a swing shaft of the presser member in the delivery direction of the recording medium under a state in which the presser member is remaining still by its own weight.

3. A recording medium delivery device according to claim 2, wherein, under the state in which the presser member is remaining still by its own weight, the bottom surface portion is inclined downwardly toward the downstream side in the delivery direction.

4. A recording medium delivery device according to claim 2, wherein the presser member further comprises a brace portion having a cavity shape, which is formed in a space between the side surface portion and the bottom surface portion, the brace portion being opened on the side surface portion side thereof.

5. A recording medium delivery device according to claim 2, wherein the presser member comprises a driven rotary member, which is arranged so as to be projected from a surface of the corner portion and is rotatable in a conveyance direction of the recording medium.

6. A recording medium delivery device according to claim 5, wherein the presser member comprises a plurality of driven rotary members positioned correspondingly to a dimension in a width direction of the recording medium to be delivered from the delivery port.

7. A recording medium delivery device according to claim 5, wherein the driven rotary member is arranged across substantially an entire region in a width direction of the presser member.

8. A recording medium delivery device according to claim 1, wherein the bottom surface portion has a rectangular shape which widens in the delivery direction and a width direction of the recording medium.

9. A recording medium delivery device according to claim 1, wherein the presser member is arranged at a position overlapping with each of both end portions in a width direction of the delivery port, when viewed from the downstream side in the delivery direction.

10. A recording medium delivery device according to claim 1, further comprising a full-load detecting member, which is arranged in a vicinity of the presser member on the downstream side in the delivery direction, and swings in the same direction as the presser member between a reference position at which the full-load detecting member makes a closest approach to the delivery tray and a detecting position at which a fully-loaded state of the recording medium stacked on the delivery tray is detected, wherein the presser member abuts against the full-load detecting member from an upstream side of the delivery direction, to thereby cause the full-load detecting member to swing together with the presser member.

11. A recording medium delivery device according to claim 10, further comprising a plurality of full-load detecting members provided along the delivery port; and the presser member abuts against, among the plurality of full-load detecting members, only the full-load detecting member positioned on an outermost side in a width direction of the recording medium.

12. A recording medium delivery device according to claim 10, wherein the full-load detecting member swings with a swing shaft as a fulcrum, the swing shaft being different from a swing shaft of the presser member.

13. An image forming apparatus, comprising the recording medium delivery device according to claim 1.

14. A recording medium delivery device, comprising:

a delivery port through which a recording medium is delivered;

a delivery tray onto which the recording medium delivered from the delivery port is to be stacked; and a presser member, which is supported in a vicinity of the delivery port on a downstream side in a delivery direction of the recording medium so as to be swingable in parallel to the delivery direction, the presser member comprising a side surface portion, which is positioned to face the delivery port, and a bottom surface portion, which is projected from a lower end of the side surface portion toward the downstream side in the delivery direction of the recording medium and is capable of pressing, from above, a trailing end of the recording medium delivered from the delivery port, the presser member wherein further comprises a corner portion at which the side surface portion and the bottom surface portion intersect each other, the corner portion being positioned on an upstream side of a swing shaft of the presser member in the delivery direction of the recording medium under a state in which the presser member is remaining still by its own weight, and the presser member further comprises a brace portion having a cavity shape, which is formed in a space between the side surface portion and the bottom surface portion, the brace portion being opened on the side surface portion side thereof.

15. A recording medium delivery device according to claim 14, wherein, under the state in which the presser member is remaining still by its own weight, the bottom surface portion is inclined downwardly toward the downstream side in the delivery direction.

16. A recording medium delivery device according to claim 14, wherein the bottom surface portion has a rectangular shape which widens in the delivery direction and a width direction of the recording medium.

17. A recording medium delivery device according to claim 14, wherein the presser member is arranged at a position overlapping with each of both end portions in a width direction of the delivery port, when viewed from the downstream side in the delivery direction.

18. A recording medium delivery device according to claim 14, further comprising a full-load detecting member, which is arranged in a vicinity of the presser member on the downstream side in the delivery direction, and swings in the same direction as the presser member between a reference position at which the full-load detecting member makes a closest approach to the delivery tray and a detecting position at which a fully-loaded state of the recording medium stacked on the delivery tray is detected, wherein the presser member abuts against the full-load detecting member from an upstream side of the delivery direction, to thereby cause the full-load detecting member to swing together with the presser member.

19. An image forming apparatus, comprising the recording medium delivery device according to claim 14.

20. A recording medium delivery device, comprising:

a delivery port through which a recording medium is delivered;

a delivery tray onto which the recording medium delivered from the delivery port is to be stacked; and a presser member, which is supported in a vicinity of the delivery port on a downstream side in a delivery direction of the recording medium so as to be swingable in parallel to the delivery direction, the presser member comprising a side surface portion, which is positioned to face the delivery port, and a bottom surface portion, which is projected from a lower end of the side surface portion toward the downstream side in the delivery direction of the recording medium and is capable of pressing, from above, a trailing end of the recording medium delivered from the delivery port, wherein the presser member comprises a corner portion at which the side surface portion and the bottom surface portion intersect each other, the corner portion being positioned on an upstream side of a swing shaft of the presser member in the delivery direction of the recording medium under a state in which the presser member is remaining still by its own weight, and the presser member comprises a driven rotary member, which is arranged so as to be projected from a surface of the corner portion and is rotatable in a conveyance direction of the recording medium.

* * * * *